US007455017B2

(12) United States Patent
Carpenter et al.

(10) Patent No.: US 7,455,017 B2
(45) Date of Patent: Nov. 25, 2008

(54) PACKAGING SYSTEM

(76) Inventors: Gary Carpenter, 1744 Auburn Dr., Carrollton, TX (US) 75007; Robbie Rex Powell, P.O. Box 117690, Carrollton, TX (US) 75011-7690

( * ) Notice: Subject to any disclaimer, the term of this patent is extended or adjusted under 35 U.S.C. 154(b) by 624 days.

(21) Appl. No.: 10/637,220

(22) Filed: Aug. 8, 2003

(65) Prior Publication Data

US 2005/0028709 A1 Feb. 10, 2005

(51) Int. Cl.
*B65D 19/00* (2006.01)

(52) U.S. Cl. ..... 108/51.11; 108/56.1; 108/55.5

(58) Field of Classification Search ..... 108/55.3, 108/55.1, 55.5, 51.11, 57.22, 57.25, 56.1; 248/346.01; 206/386, 600, 598
See application file for complete search history.

(56) References Cited

U.S. PATENT DOCUMENTS

| | | | | | |
|---|---|---|---|---|---|
| 3,581,681 | A | | 6/1971 | Newton | |
| 3,613,605 | A | | 10/1971 | Holdredge, Jr. | |
| 3,667,403 | A | | 6/1972 | Angelbeck, Jr. | |
| 3,710,733 | A | | 1/1973 | Story | |
| 3,719,157 | A | | 3/1973 | Arcocha et al. | |
| 3,891,170 | A | * | 6/1975 | Bricker et al. | 108/55.3 |
| 3,951,078 | A | | 4/1976 | Fowler et al. | |
| 4,244,471 | A | | 1/1981 | Plante | |
| 4,257,523 | A | * | 3/1981 | Blasio | 108/55.3 |
| 4,339,039 | A | | 7/1982 | Mykleby | |
| 4,467,728 | A | | 8/1984 | Horne | |
| 4,809,618 | A | | 3/1989 | Bell | |
| 4,851,286 | A | | 7/1989 | Maurice | |
| 5,139,153 | A | | 8/1992 | Delamare et al. | |
| 5,180,134 | A | * | 1/1993 | Mallak | 248/544 |
| 5,476,048 | A | | 12/1995 | Yamashita et al. | |
| 5,497,708 | A | * | 3/1996 | Jeruzal | 108/54.1 |
| 5,505,141 | A | | 4/1996 | Barber | |
| 5,676,063 | A | * | 10/1997 | Wallace | 108/55.3 |
| 5,842,424 | A | * | 12/1998 | Prevot et al. | 108/54.1 |
| 5,845,588 | A | | 12/1998 | Gronnevik | |
| 5,876,813 | A | | 3/1999 | Bambara et al. | |
| 5,937,767 | A | | 8/1999 | Togawa et al. | |
| 5,970,885 | A | * | 10/1999 | Polando | 108/55.3 |
| 6,126,131 | A | * | 10/2000 | Tietz | 248/346.01 |
| 6,352,039 | B1 | | 3/2002 | Woods et al. | |
| 6,524,426 | B1 | * | 2/2003 | St. John et al. | 108/57.25 |

* cited by examiner

*Primary Examiner*—José V Chen
(74) *Attorney, Agent, or Firm*—Schultz & Associates

(57) ABSTRACT

A system for use in the packing of an appliance containing the pallet and corner members is provided. The pallet comprises first and second support members and a connecting cross member, wherein the cross member is substantially perpendicular to the first and second support members. The first and second support members include attachment holes, wherein the attachment holes allow for the attachment of the pallet to the appliance. The first and second support members and the cross member are manufactured from a synthetic substance and are substantially hollow. The system further comprises corner pieces and standoffs used to stabilize and protect the appliance in a container.

4 Claims, 7 Drawing Sheets

PACKAGING SYSTEM

CROSS-REFERENCE TO RELATED APPLICATIONS

Not Applicable.

FIELD

The present invention is related to a packaging system, and more particularly to a synthetic packaging system for supporting appliances.

BACKGROUND

Packaging pallets are typically made of wood and are commonly constructed using a box frame with deck boards attached to form a flat surface. Wood pallets perform the desired function however, the wood pallets add excessive weight and cost and are environmentally wasteful. A manufacturer's goods are then placed upon the flat surface of the pallet for transport. Pallets are designed to allow for ease of transportation and allow for movement through the use of mechanical means such as a forklift. However, a manufacturer must account for the additional costs associated with the additional delivery weight of a pallet and packaging.

Plastic pallets have been developed to meet some of the shortcomings of wood pallets. An example of such a pallet is described in U.S. Pat. No. 6,352,039 entitled "Plastic Pallet," issued to Woods, et al. The plastic pallet includes a frame and deck boards attached to the frame without the use of mechanical fasteners. A second example is shown in U.S. Pat. No. 3,581,681 entitled "Pallet," issued to Newton. In the Newton patent, a pallet constructed of a thin-walled, resinous shell filled with a foam core bonded to the inside surface of the shell. The shell of the Newton pallet includes integral support beams spaced appropriately to accommodate a forklift. The Newton pallet is constructed to meet basic strength requirements at a low cost.

A benefit of transporting goods attached to pallets is that the pallet can provide protection from external elements. An example of such a system is shown in U.S. Pat. No. 4,244,471 entitled "Packaging System," issued to Plante. In the Plante packaging system, top and bottom caps for packaging appliances are shown. The top and bottom caps are attached via a plurality of corner angles extending vertically between the top and bottom caps. The corner angles have a length greater than the height of the appliance so that a space exists between the appliance and the top cap. The packaging system is rigid and thus allows multiple systems to be placed upon each other.

Pallets are also used in the manufacture of appliances. The base of the appliance is fixedly attached to the pallet before construction. The pallet is moved down an assembly line via a conveyor belt or other transportation system and the appliance is constructed on the base. Once construction is completed, the remaining packaging is attached to the pallet and the appliance is then transported to its destination. The remaining packaging system often includes a cardboard box that fits over the appliance. Often the corners of the cardboard box are reinforced with a light metal, Styrofoam, corrugated or paperwrap corners.

SUMMARY OF THE INVENTION

The invention provides a packing system for use with the transportation and manufacture of an appliance, such as refrigerators, ranges and the like. The system includes a pallet, corner support members and spacing members. In the preferred embodiment, each of these pieces fits into a correlated cardboard box and can be used together or separately. The pallet comprises support members and connecting cross members, wherein the cross members are substantially perpendicular to the support members. The first and second support members include attachment holes, wherein the attachment holes allow for the attachment of the pallet to the appliance. The first and second support members and cross members are manufactured from a synthetic substance and are substantially hollow. The corner support members are used to reinforce the corners of the cardboard box and protect the edges of the appliance. The corner support can be members of various shapes and lengths sized for specific applications. The spacing members are used to position the appliance in the cardboard box and to protect various protrusions on the appliance from damage.

A system according to the preferred embodiment of the invention reduces the weight and costs of the packaging and can be recycled. Another advantage of the disclosed invention is the reduction of damage to the system by outside elements. For instance, pallets made according to the invention do not absorb moisture and odors and do not disintegrate after exposure to such elements.

BRIEF DESCRIPTION OF THE DRAWINGS

For a more complete understanding of the present invention, and for further details and advantages thereof, reference is now made to the following Detailed Description taken in conjunction with the following drawings, in which.

DETAILED DESCRIPTION OF THE DRAWINGS

Figure 1:
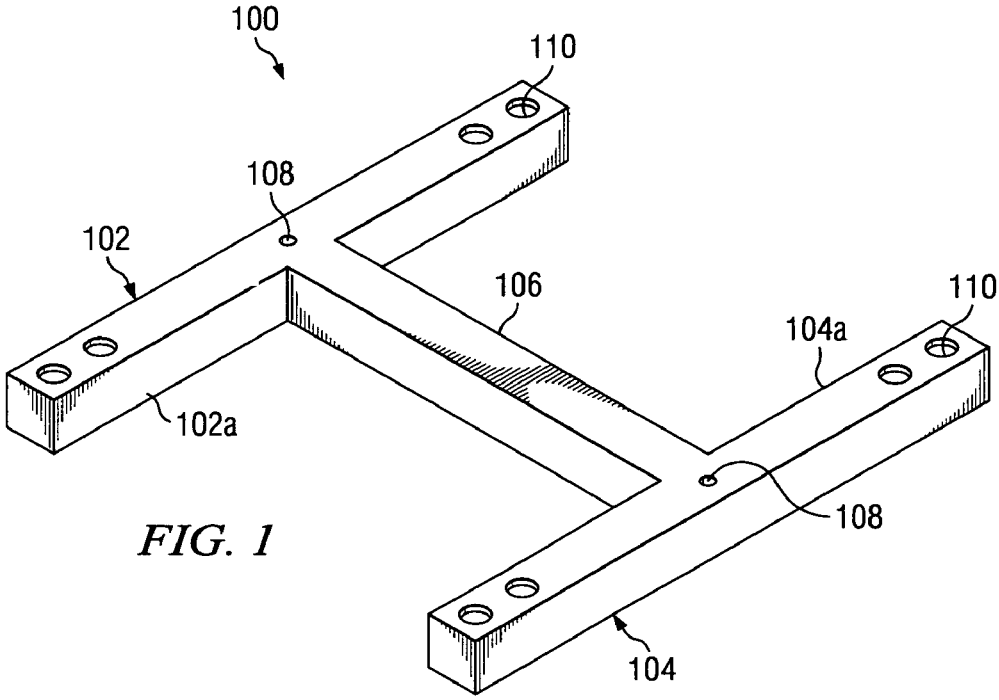
FIG. 1 is an isometric view of a pallet according to the invention.

In the descriptions which follow, like parts may be marked with the same numerals. The drawing figures are not necessarily drawn to scale and certain figures may be shown in exaggerated or generalized form in the interest of clarity and conciseness.

Figure 2:
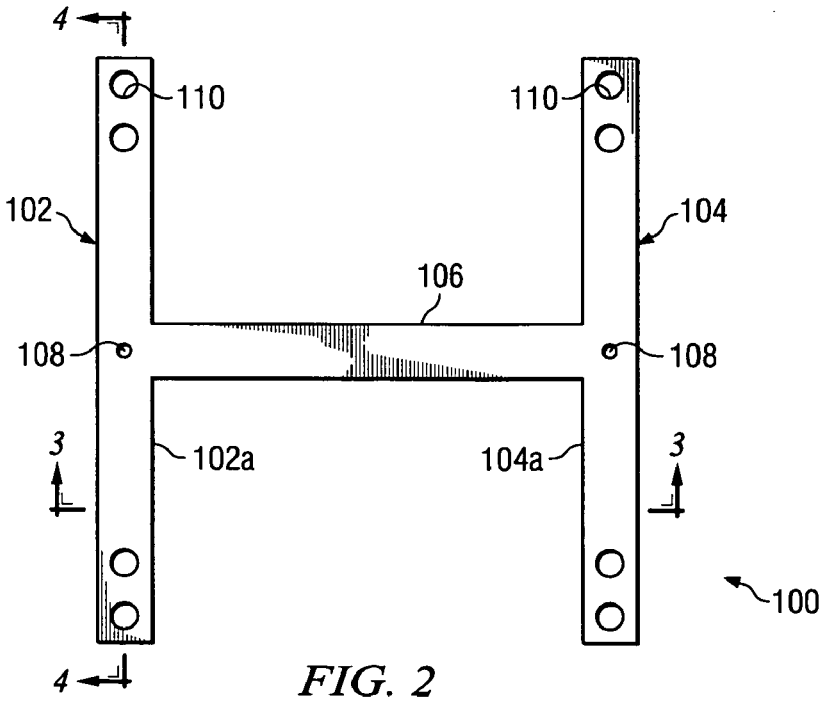
FIG. 2 is a plan view of a pallet according to the invention.

Referring now to FIGS. 1 and 2, an appliance pallet is shown. An "H" shaped pallet 100 includes support members 102 and 104 connected by a cross member 106 which is substantially perpendicular to the support members 102 and 104. The interior sides 102*a* and 104*a* of support members 102 and 104 are connected to the cross member 106. Pallet 100 can be manufactured as a single piece or can be assembled from multiple, separate pieces. Pallet 100 can be cast or extruded or cast pieces can be assembled to form the pallet. Assembly techniques for plastic elements are known to those skilled in the art and can include adhesives, inductive welding or physical connectors such as pop rivets or other methods known in the art. In one disclosed embodiment the pallet is formed from plastic, such as High Density Polyethylene (HDPE), however a wide variety of materials may be used to form the pallet, including, but not limited to, HIPS, LDPE, polypropylene, polyethelene and Crosslink PE. The thickness of the walls of the support members and cross members in the preferred embodiment is between 0.010-0.100 of an inch in thickness.

Pallet 100 includes bolt holes 108. Bolt holes 108 are designed to allow for various appliances to be directly attached to the pallet. Retaining bolts are placed through the holes and into an appliance to secure the pallet to the appliance. Adhesive attachment can also be used as can removable straps. Also included are feet holes 110 for placement of feet of appliance. Once the appliance (not shown) is attached to pallet 100, which in one disclosed embodiment includes bolts, the H shaped pallet 100 and the appliance can be moved as a single piece. A wide variety of attachment mechanisms can be implemented without detracting from the spirit of the invention.

In another embodiment, the frame of the appliance (not shown) can be attached to the pallet at the beginning stages of manufacture of the appliance. The appliance frame and the pallet are then moved along an assembly line allowing the appliance to be completed while attached to the pallet. The appliance and the pallet can then be packaged for shipment after completion of the appliance. A wide variety of appliances can be attached to the pallet, including as examples computers, ranges, washing machines, refrigerators and dish washers.

In another embodiment (not shown), the pallet 100 extends beyond the edges of the appliance and includes corners with extend up the edges of the appliance. In this embodiment the pallet is not necessarily attached to the appliance.

Figure 3:
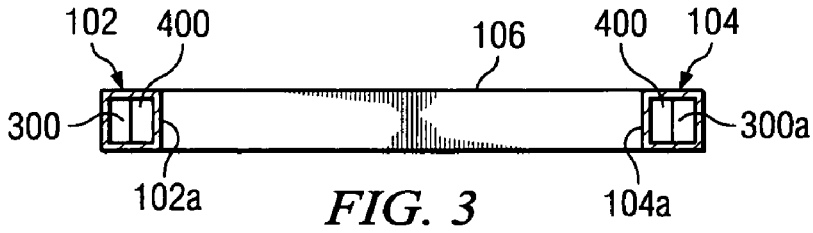
FIG. 3 is a section view through line 3 of a pallet according to the invention.
Figure 4:
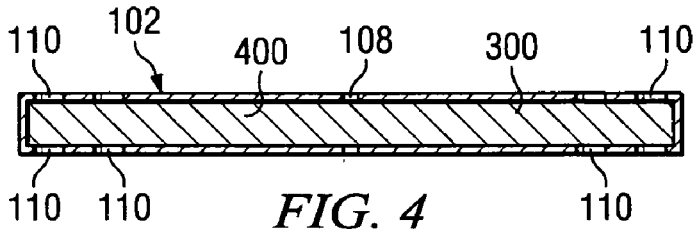
FIG. 4 is a section view through line 4 of a pallet according to the invention.

The interior views of the support members 102 and 104 are shown in FIGS. 3 and 4. In FIG. 3, a cross sectional view through line 3 of FIG. 2 is shown. In FIG. 4, a cross sectional view through line 4 of FIG. 2 is shown. The support members 102 and 104 are shown forming hollow spaces 300 and 300*a*. The cross-sectional shapes formed by the support members 102 and 104 are substantially square. However, various cross-sectional shapes can be implemented without detracting from spirit of the invention, including but not limited to rectangular, oval, and circular. The hollow spaces 300 and 300*a* can remain hollow, can be filled with a rigid or flexible plastic foam substance to enhance strength, or can include an interior support, such as those shown in FIG. 4 and in FIGS. 5A-5D. The wall thickness of the support members 102 and 104 can be varied to allow for weight differences of the varying appliances. For example, a greater wall thickness can be implemented for heavy cold storage devices.

Cross member 106 is shown attached to support members 102 and 104. In one embodiment, the cross member 106 is manufactured with a smaller cross-sectional area than either of the support members 106. In this embodiment, the cross member 106 provides support to the support members 102 and 104 but does not directly bear the weight of the appliance. The cross member 106 increases the stiffness of the pallet and reduces the level of deflection under torsional loads. In another embodiment, the cross member 106 cross-sectional area is equal to the cross-sectional areas of the support members 102 and 104. In this embodiment, the cross member 106 provides support to the support members 102 and 104 and can be implemented to bear some of the weight of the appliance. In another embodiment, cross member 106 is attached to support members 102 and 104 at interior sides 102*a* and 104*a*. In another embodiment, the cross member 106 is attached to either the top or bottom surface of the support members 102 and 104.

FIG. 4 shows a support member 102 with an offset channel rib 400. Offset channel rib 400 is offset from center and vertically extends the length of support member 102. More than one offset channel rib 400 can be located in support member 102 offset from channel rib 400 to provide additional strength to the support member 102 without incurring substantial increases in weight and costs.

Figure 5A:
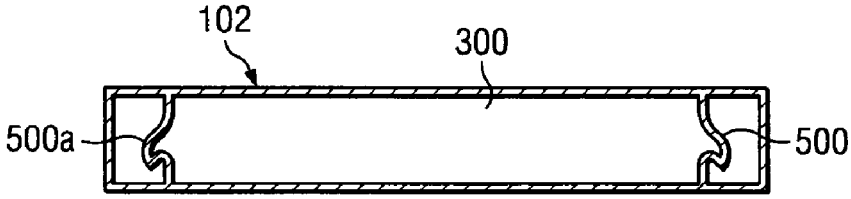
FIGS. 5A-D are section views of support members according to alternate embodiments of the invention.

FIGS. 5A-5D show various internal support structures. Support member 102 may be formed without support structures but may also include them. FIG. 5A shows a cross-section of support member 102 including wave supports 500 and 500*a*. Wave supports 500 and 500*a* are located in the hollow space 300. The wave supports 500 and 500*a* provide additional strength without incurring substantial increases in weight and costs.

Figure 5B:
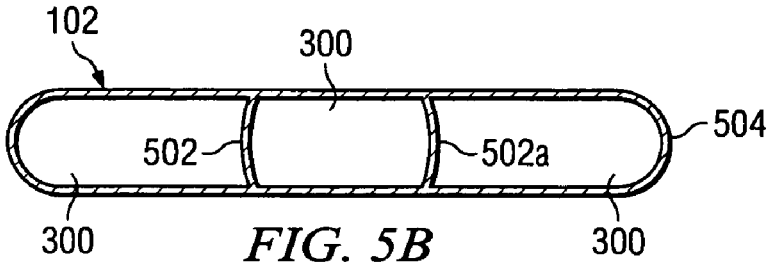

In FIG. 5B, an alternate interior support structure is shown. Support member 102 includes a rounded edge 504. The oval hollow space 300 includes interior support structures 502 and 502*a*. The interior support structures 502 and 502*a* of the preferred embodiment are curved. The curved interior support structures 502 and 502*a* provide additional strength without incurring substantial increases in weight and costs.

Figure 5C:
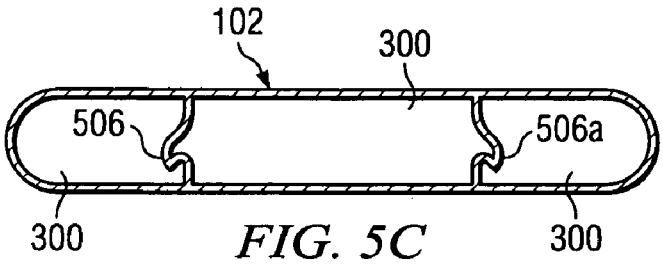

In FIG. 5C, the wave support structures 506 and 506*a* are shown in an oval hollow space 300. In this embodiment, the wave support structures 506 and 506*a* are located nearer the center of the cross-sectional area of the support member 102. The location of the support structures in the hollow space 300 can be varied to accommodate different stiffness levels and to accommodate the varying weights of different appliances, however, various other locations are possible.

Figure 5D:
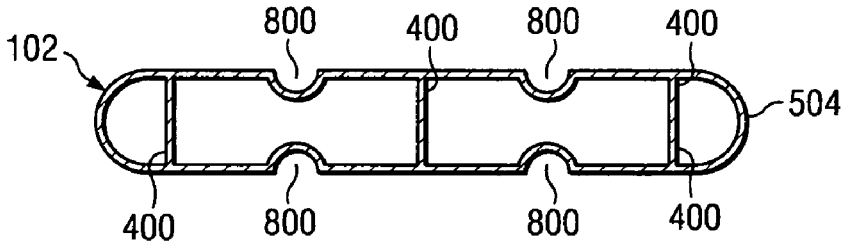

FIG. 5D shows an alternate cross-section of support member 102. The outside profile of support member 102 may have one or more saddle regions 800 for lateral support. Support member 102 is shown having three offset channel ribs 400. Other embodiments could have more or fewer internal support structures of various shapes as previously described.

Figure 6:
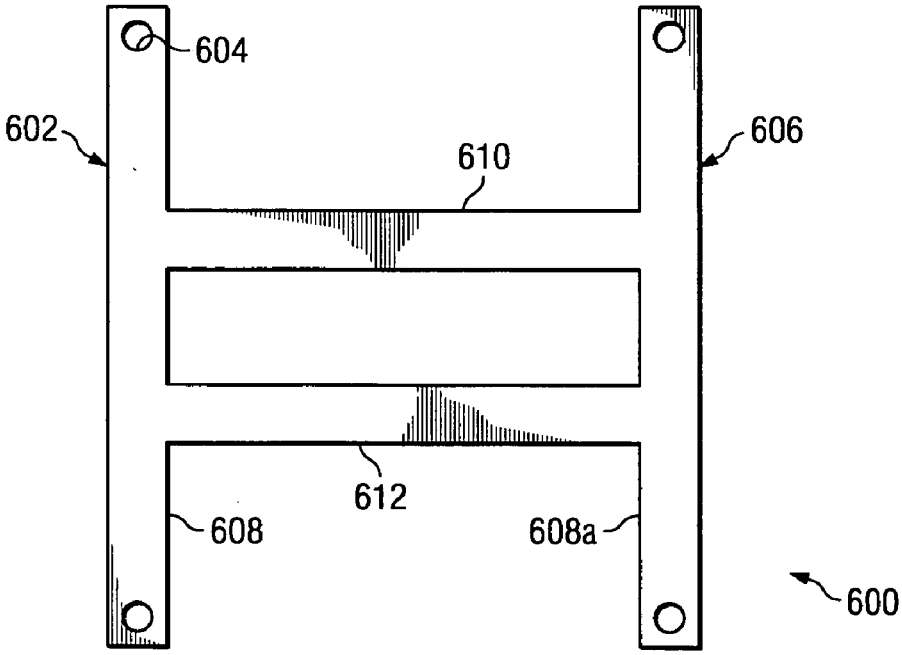
FIG. 6 is a plan view of a pallet according to an alternate embodiment of the invention.

In FIG. 6, an alternate embodiment of a pallet of the invention is shown. Dual cross member pallet 600 includes support members 602 and 606. The support members 602 and 606 are connected with cross members 610 and 612. The cross members 610 and 612 are attached at the interior sides 608 and 608*a* of the support members 602 and 606. Bolt holes 604 are shown in the support members 602 and 606 and can be used to attach the dual cross member pallet 600 to an appliance. In this embodiment two cross members 610 and 612 are shown, however, multiple cross members can be used.

Figure 7:
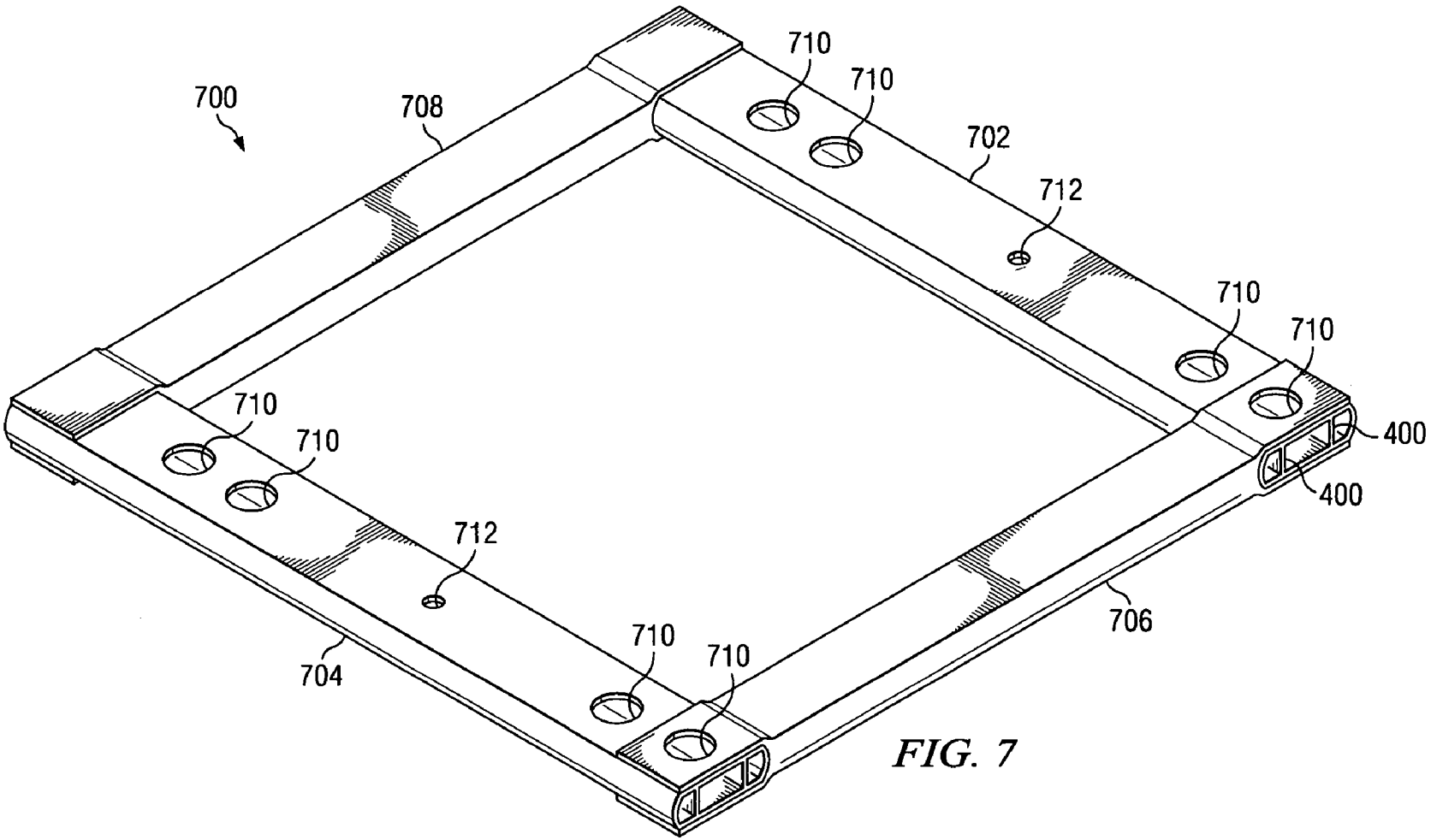
FIG. 7 is an isometric view of a pallet according to an alternate embodiment of the invention.

In FIG. 7, an alternate embodiment of the pallet of the invention is shown. A square pallet 700 includes support member 702 and 704. The support members 702 and 704 are connected with cross members 706 and 708 by a pair of generally parallel flanges extending from each end of cross members 706 and 708 that overlap the upper and lower surfaces of the ends of support members 702 and 704, respectively. Cross members 706 and 708 are attached at the ends of support members 702 and 704. Cross members 706 and 708 and support members 702 and 704 may have alternate cross-sections such as those shown in FIGS. 5A-5D. Bolt holes 712 are shown in support members 702 and 704 and can be used to attach square pallet 700 to an appliance with retaining bolts. Also, appliance feet holes 710 may be located in support members 702 and 704 and cross members 706 and 708 to accommodate feet found on the appliance.

Figure 8A:
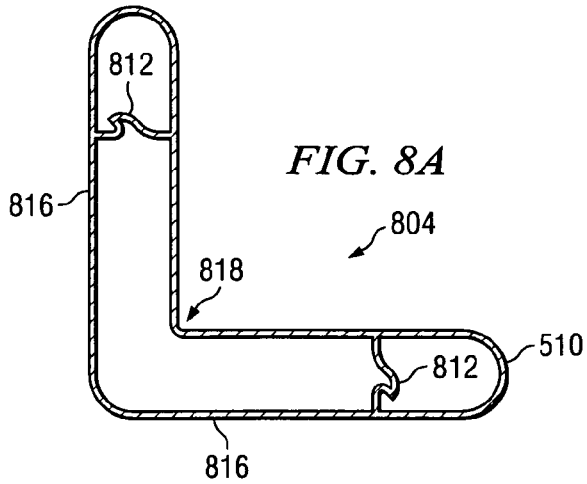
FIGS. 8A-C are section views of corner support members according to alternate embodiments of the invention.
Figure 8B:
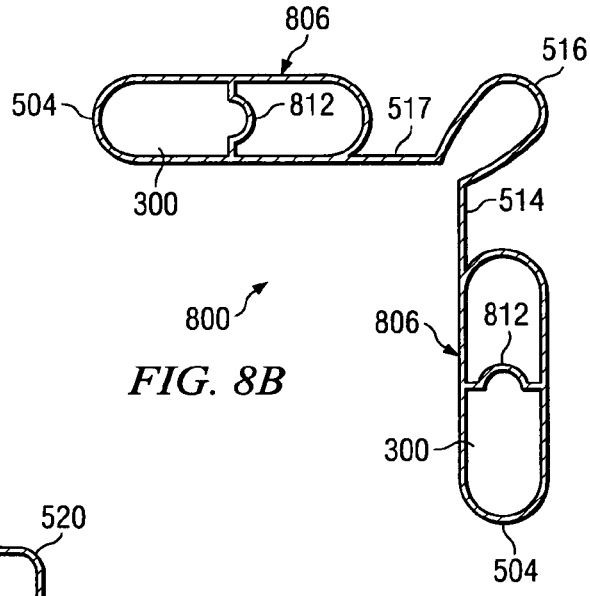
Figure 8C:
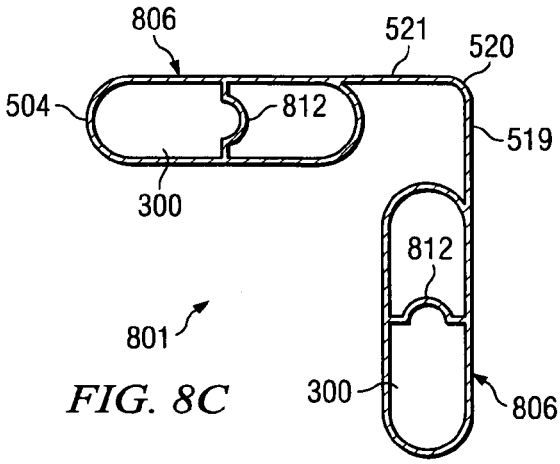

Once the appliance is fully constructed and ready to be shipped, a cardboard box can be secured around the appliance to protect the appliance during transport. The cardboard box can be corrugated or non-corrugated. FIGS. 8A-C show alternate corner support member structures designed to be inserted in or near the corners of the cardboard box.

FIGS. 8A-C show cross-sections of the alternate corner support member structures. The structures of the preferred embodiment are extended to a predetermined length with a constraining cross section. The cross section includes internal support members 812. Curved internal support members 812 provide additional strength to the corner support member during use without incurring substantial increases in weight and expense. Also, during manufacture after the corner support member has been extruded and is cooling, internal support members 812 add support to the pliable walls until the walls can cool and strengthen. The internal support members 812 may be straight or have a curved profile. The corner support members may not have any internal support members or may have one or more internal support members depending on the type of internal support desired.

The alternate corner support member structures are formed from plastic, such as High Density Polyethylene (HDPE), however a wide variety of manufacturing materials may be used to form the support member structures without detracting from the spirit of the invention, including, but not limited to, HIPS, LDPE, polypropylene, polyethelene and Crosslink PE. The preferred thickness of the walls of the corner support member structures, such as internal support members 812, is between 0.010 and 0.100 of an inch in thickness.

In FIG. 8A, corner support member 804 has an upper case "L" profile having extensions 816 and corner 818. In use, corner 818 fits next to a corner edge of the appliance extending along and overlapping the corner of the appliance to protect it from damage and secure it during transport.

In FIGS. 8B and 8C, alternate embodiments of the corner support members are shown. In FIG. 8B, corner support member 800 includes individual support lobes 806 connected by beam 514, loop 516 and beam 517. The support lobes are substantially tubular members which are held at positions approximately perpendicular to each other by beam 514, loop 516 and beam 517. Loop 516 provides shock resistance to impact loads directed towards the corners of the appliance. In FIG. 8C, corner support member 801 includes support lobes 806 connected by beam 519, corner 520 and beam 521.

Figure 9A:
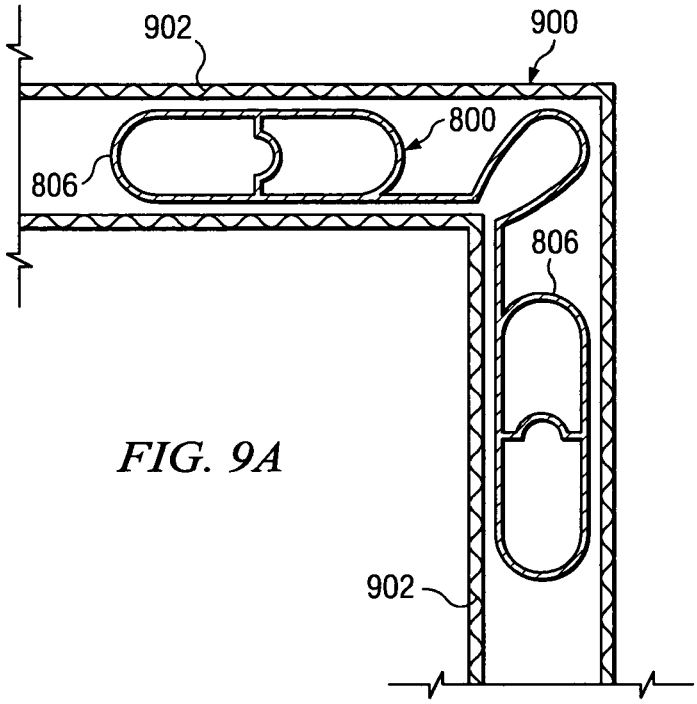
FIGS. 9A-B are section views of corner support members in use.
Figure 9B:
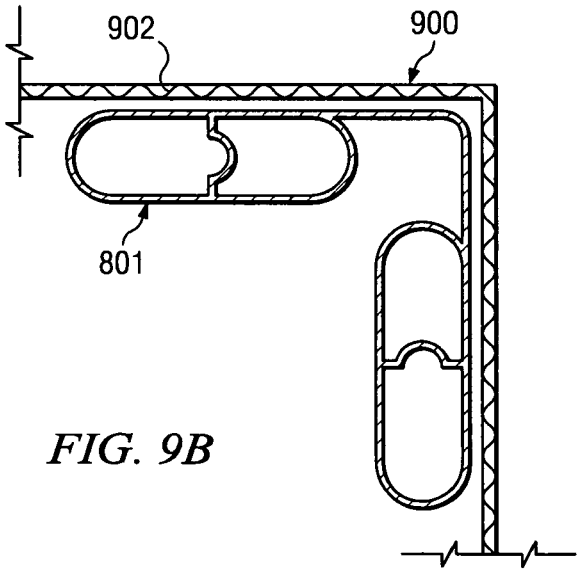

The various corner support structures shown in FIGS. 8A-C can be contained within the walls of or proximate to an interior wall of a cardboard box or packing container. For example, FIG. 9A shows corner support member 800 inside the walls 902 of a packing box 900. FIG. 9B shows the corner support member 801 proximate to an interior wall 902 of a packing box 900. The corner support member structures can vary in height, length, and dimensions and can be positioned in the top corners, bottom corners, or side corners of the shipping container depending on the desired cost, stacking strength, horizontal cushioning, vertical cushioning and corner cushioning desired.

In FIGS. 10A-D, alternate embodiments of a wall spacing member are shown. The wall spacing member is a special type of corner support structure which extends past an outside wall of the appliance and contacts the inside wall of the container surrounding the appliance. The purpose of the wall spacing members is to form a standoff to distance the container from protrusions such as handles, knobs or display panels that extend past the outside wall, top or bottom of the appliance.

Figure 10A:
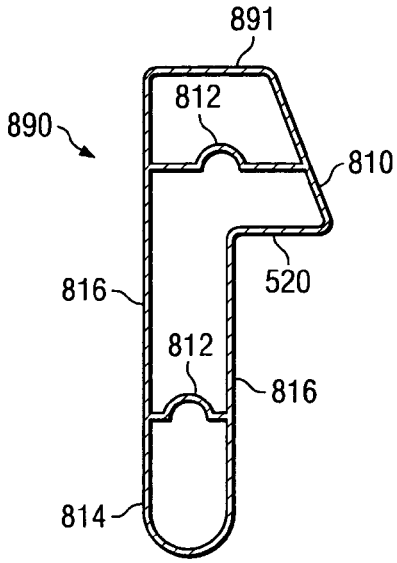
FIGS. 10A-D are section views of wall spacing members according to alternate embodiments of the invention.

Referring to FIG. 10A, a wall spacing member 890 is shown whose cross section includes a head section 810, a placement surface 891, and a tail section 814. The tail section contains two walls 816 separated by an internal support member 812. The length of walls 816 extend to head section 810. Head section 810 includes an internal support member 812 and is formed with a notch 520. In use, notch 520 makes contact with the edge of an appliance while placement surface 891 contacts the inside of the container. Head section 810 forms a spacer for the protrusions of the appliance. The distance the head section 810 extends past the wall of the appliance depends on the profile of head section 810.

Figure 10B:
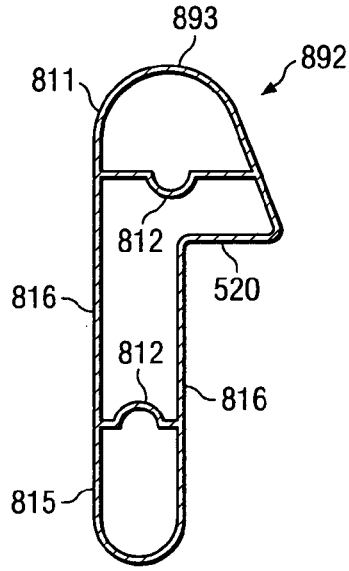

Referring to FIG. 10B, wall spacing member 892 is shown with a cross section that has a head section 811 and a tail section 815. The tail section contains two walls 816 separated by an internal support member 812. Head section 811 includes an internal support member 812 and is formed with a notch 520. Notch 520 makes contact with the edge of an appliance, while placement surface 893 contacts the inside of the packing box 900. Placement surface 893 is curved to accommodate different types of packing containers. Head section 811 forms a spacer for the protrusions of the appliance.

Figure 10C:
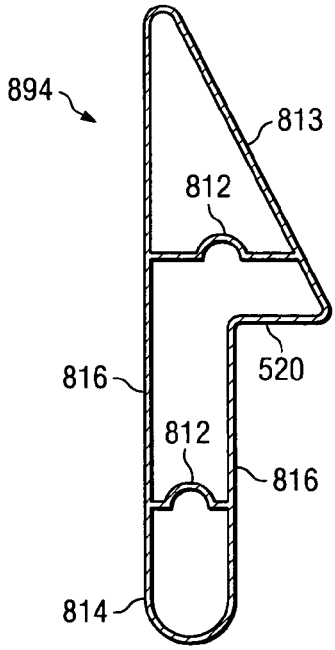

Referring to FIG. 10C, a spacing member 894 is shown with a cross section that has a triangular head section 813. Triangular head section 813 accommodates different types of packing containers.

Figure 10D:
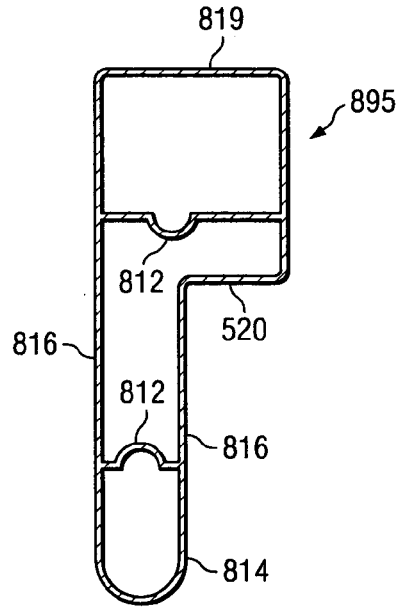

Referring now to FIG. 10D, a wall spacing member 895 is shown that has a head section 819. Head section 819 is formed in the shape of a square in order to accommodate different types of packing containers.

FIGS. 10A and 10B show a relatively small head profile wherein head section 810 would extend a relatively short distance from the walls of the appliance. The wall spacing members shown in FIGS. 10A and 10B would be used for protrusions such as knobs or dials. The wall spacing members shown in FIGS. 10C and 10D would be used for larger protrusions such as handles.

Other embodiments of the invention will be apparent to those skilled in the art after considering this specification or practicing the disclosed invention. The specification and examples above are exemplary only, with the true scope of the invention being indicated by the following claims.

The invention claimed is:

1. A pallet for use in the manufacture and transportation of an appliance comprising:

a first support member having at least one first appliance foot hole through which a bottom of the appliance is fit flush against the first support member and a first hole through which the appliance is fastened with a first retaining bolt;

a second support member having at least one second appliance foot hole through which the bottom of the appliance is fit flush against the second support member and a second hole through which the appliance is fastened with a second retaining bolt;

a first cross member;

the first cross member having a first pair of flanges, the first pair of flanges rigidly affixed to an upper surface of the first support member and a lower surface of the first support member at a first end of the first support member;

the first cross member having a second pair of flanges, the second pair of flanges rigidly affixed to an upper surface of the second support member and a lower surface of the second support member at a first end of the second support member;

a second cross member;

the second cross member having a third pair of flanges, the third pair of flanges rigidly affixed to the upper surface of the first support member and the lower surface of the first support member at a second end of the first support member;

the second cross member having a fourth pair of flanges, the fourth pair of flanges rigidly affixed to the upper surface of the second support member and the lower surface of the second support member at a second end of the second support member.

2. The pallet of claim 1, wherein the first and second support members and the first and second cross members are formed of an extruded material.

3. The pallet of claim 1 wherein the at least one first appliance foot hole, at least one second appliance foot hole, first hole and second hole are placed in an asymmetrically aligned pattern with respect to an axis of the pallet through the center of the first support member and the center of the second support member.

4. The pallet of claim 1 wherein the first support member and second support member include a first set of four appliance foot holes forming the corners of an inner rectangle and a second set of four appliance foot holes forming the corners of an outer rectangle.

* * * * *